US010431048B2

(12) United States Patent
Ghia et al.

(10) Patent No.: US 10,431,048 B2
(45) **Date of Patent: *Oct. 1, 2019**

(54) SMART BIN LOTTERY TICKET DISPENSER WITH REMOTE ELECTRONIC DISPLAY

(71) Applicant: Scientific Games International, Inc., Newark, DE (US)

(72) Inventors: Ajay J. Ghia, Cumming, GA (US); William F. Behm, Roswell, GA (US); Kent Christensen, Cumming, GA (US); Sten Hallundbaek Mejenborg, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 369 days.

This patent is subject to a terminal disclaimer.

(21) Appl. No.: 15/394,106

(22) Filed: Dec. 29, 2016

(65) Prior Publication Data

US 2018/0190073 A1 Jul. 5, 2018

(51) Int. Cl.
*G07F 17/32* (2006.01)
*G07F 17/42* (2006.01)

(52) U.S. Cl.
CPC ..... *G07F 17/329* (2013.01); *G07F 17/3225* (2013.01); *G07F 17/3248* (2013.01); *G07F 17/42* (2013.01); *G07F 17/3211* (2013.01); *G07F 17/3253* (2013.01)

(58) Field of Classification Search
CPC .... G07F 17/329; G07F 17/42; G07F 17/3225; G07F 17/3248
See application file for complete search history.

(56) References Cited

U.S. PATENT DOCUMENTS 5,222,624 A * 6/1993 Burr ..... G07C 15/005 221/1
5,893,797 A * 4/1999 Marino ..... G07C 15/006 463/17
6,095,624 A * 8/2000 Wilbert ..... G07B 3/04 312/293.3
6,886,728 B2 * 5/2005 Roberts ..... B05D 3/067 225/100
7,016,861 B2 * 3/2006 Mothwurf ..... G06Q 30/0212 221/255
7,665,394 B2 * 2/2010 Roberts ..... G07F 11/68 221/1
9,911,278 B2 * 3/2018 Katz ..... G07F 17/329
10,071,848 B2 * 9/2018 Ghia ..... B65D 83/12
(Continued)

*Primary Examiner* — William H McCulloch, Jr.
(74) *Attorney, Agent, or Firm* — Dority & Manning, P.A.

(57) ABSTRACT

A lottery ticket dispenser system includes a physical dispenser array having a plurality of separate bins for receipt of a supply of interconnected lottery tickets. A control system is in communication with a drive mechanism in each bin to initiate a dispense sequence upon receipt of a ticket dispense command. A central lottery server is in communication with the control system. An electronic display device is in communication with the central lottery server and is configured to present a virtual dispenser array with bin positions that mimics the physical dispenser array. The central lottery server transmits lottery ticket images to the electronic display device that correspond to the lottery tickets in the physical dispenser array and bin position assignments for the lottery ticket images in the virtual dispenser array.

10 Claims, 4 Drawing Sheets

(56) References Cited

U.S. PATENT DOCUMENTS

| | | | | |
|---|---|---|---|---|
| 10,235,843 | B2 * | 3/2019 | Ghia | G07F 17/329 |
| 2001/0034263 | A1 * | 10/2001 | Roberts | B26F 3/002 463/17 |
| 2002/0045477 | A1 * | 4/2002 | Dabrowski | G06Q 20/10 463/29 |
| 2005/0233797 | A1 * | 10/2005 | Gilmore | G06Q 20/202 463/17 |
| 2006/0071046 | A1 * | 4/2006 | Roberts | G07F 11/68 225/10 |
| 2009/0221343 | A1 * | 9/2009 | Ekisheva | G07F 17/329 463/17 |
| 2009/0247281 | A1 * | 10/2009 | Voutes | G07F 17/32 463/25 |
| 2009/0247287 | A1 * | 10/2009 | Voutes | G07F 17/32 463/25 |
| 2016/0012680 | A1 * | 1/2016 | Katz | G07F 17/3248 463/25 |
| 2017/0018148 | A1 * | 1/2017 | Behm | G07F 17/42 |
| 2017/0053495 | A1 * | 2/2017 | Breslo | G07F 17/3258 |
| 2018/0005482 | A1 * | 1/2018 | Ghia | G07F 17/323 |
| 2018/0186557 | A1 * | 7/2018 | Ghia | B65D 83/12 |
| 2018/0186559 | A1 * | 7/2018 | Mejenborg | B65D 83/12 |
| 2018/0190065 | A1 * | 7/2018 | Ghia | G07F 17/329 |
| 2018/0190073 | A1 * | 7/2018 | Ghia | G07F 17/3253 |

* cited by examiner

SMART BIN LOTTERY TICKET DISPENSER WITH REMOTE ELECTRONIC DISPLAY

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

Most conventional lottery ticket dispensers (manual or electronic) not only serve to dispense tickets, but also to advertise to potential purchasers the various tickets that are for sale from the dispenser. For example, conventional multi-bin dispensers typically include a sample ticket on display in each bin that is visible to purchasers facing the bin. In this way, the purchaser knows exactly which lottery tickets are in the respective bins. However, using the dispenser for this purpose in a retail establishment requires that the dispenser be at a location that is both visible to customers and accessible to the clerk for retrieving lottery tickets from the bin. This location is typically the counter at or near the store register, resulting in the dispenser taking up valuable counter space and hampering other transactions at the counter.

In addition, with conventional dispenser arrays, the ticket locations in the array are static. In other words, once tickets are loaded into an individual bin in the array, they will stay there until the tickets are exhausted or exchanged out for another game. Particularly for larger dispenser arrays having multiple bins, certain "prime" bin locations are inherently more visible and noticeable to purchasers, and tickets in these locations tend to sell better. For example, tickets in bins in the center of the array, or at eye height to customers, are more likely to sell as compared to tickets in bins that are located in the corners of the array, or below or above eye height to the customer. One means to remedy this situation would be to periodically change location of the tickets within the dispenser array. However, this is a time-consuming and impractical solution.

Accordingly, the lottery and retail industry would benefit from a multi-bin lottery ticket dispenser array that serves to advertise to potential purchasers the exact tickets in the array without concern to location of the array, while also serving to change ticket positions within the array at periodic times.

SUMMARY

Objects and advantages of the invention will be set forth in part in the following description, or may be obvious from the description, or may be learned through practice of the invention.

In accordance with aspects of the invention, a lottery ticket dispenser system is provided for dispensing instant or other preprinted lottery tickets at a retail establishment. The type of retail establishment may vary widely within the scope and spirit of the invention. For example, in certain embodiments, the retail establishments may be convenience stores, gas stations, pubs, and any other establishment that typically sells lottery tickets to the public. The present array has particular usefulness for much larger retail establishments, such as "big-box" retail stores that are part of a national or other geographic chain, wherein the sale of lottery ticket sales has generally not been implemented.

The dispenser system includes a dispenser array having a plurality of separate bins, for example an array of 3×4 separate bins, wherein each bin is defined by a housing (e.g., a multi-sided housing) that defines an internal space for receipt of a supply of interconnected lottery tickets therein, such as a fan-folded stack or roll of interconnected lottery tickets. Each bin may contain a supply of different scratch-off lottery ticket games, or two or more bins may contain a respective supply of tickets for the same game. Each lottery ticket generally includes a machine readable code printed thereon, such as an alpha-numeric code, bar code, QR code, or the like, that includes any manner of information used to identification, verification, redemption, and accountability of the ticket Each bin in the array includes an electronic drive mechanism that, when activated, dispenses one or more lottery tickets from the bin (depending on the number of tickets requested by the patron).

A control system is in communication with the drive mechanism to initiate a dispense sequence upon receipt of a ticket dispense command.

Each bin is also configured with a scanner disposed to read the code on lottery tickets dispensed from the bin position. In operation of the system, a purchase signal for dispensing a particular lottery ticket is routed to the respective bin containing the lottery ticket, which activates the drive mechanism to dispense the requisite number of tickets. As the tickets are dispensed from the bin, the scanner reads the code printed on each ticket.

A central lottery server is in communication with the array control system. This central lottery server may be common to a plurality of different arrays located within a defined lottery jurisdiction or region.

An electronic display device in communication with the central lottery server. This display device may be, for example, a video monitor or screen (e.g., an LCD screen). The electronic display device is configured to present a virtual dispenser array with bin positions that mimics a physical dispenser array. In other words, the virtual dispenser array is an electronic video representation of a physical array. The virtual image need not be identical to the physical array, but generally depicts a dispenser array that customers are familiar with. In a certain embodiment, the virtual array will include the same number of bin positions as the physical array, and may display the bin positions is the same pattern/order as the physical array. In another embodiment, the virtual array displays the bin positions in a different pattern as compared to the physical array.

The central lottery server is configured to transmit lottery ticket images to the electronic display device that correspond to the actual lottery tickets in the physical dispenser array. These images may be generated and stored in a library that is accessed by the central lottery server. The central lottery server also transmits bin position assignments to the electronic display device that dictates the bin positions in the virtual array for the respective lottery ticket images.

The electronic display device is positionable remotely from the actual dispenser array in the retail establishment and presents the virtual dispenser array to potential customers in an image that the customers are used to seeing and comfortable with. For example, the physical dispenser array may be located below the counter at the retail check-out register, but still accessible to the store clerk for retrieving the tickets dispensed automatically therefrom. The electronic display device, on the other hand, may be mounted on a wall or other support surface near the register so as to be readily seen by customers without occupying valuable space on or near the counter.

In certain embodiments of the system, the control system is configured to generate a bin ID signal and a lottery ticket ID signal upon the supply of lottery tickets being loaded into each bin of the physical array, and to transmit the bin ID and ticket ID signals to the central lottery server. The ticket ID signal can be generated from information contained in the ticket codes printed on the lottery tickets loaded into the bins, whereas the bin ID signal may be a hard-wired signal associated with each bin. With this information, the central lottery server is able to track the number of actual lottery tickets dispensed (e.g., sold) from each bin of the physical dispenser array, and thus generate an inventory of the tickets in each bin at any given time.

In particular embodiments, the central lottery server is configured to generate new bin position assignments for the lottery ticket images in the virtual dispenser based on the tracked lottery tickets dispensed from the physical dispenser array. These new bin positions may be based on any combination of factors, but generally will be a function of increasing or decreasing sales of certain lottery tickets as a function of bin position in the virtual dispenser array. For example, if tickets corresponding to images located in the corner bin positions of the virtual array are not selling as well as tickets corresponding to more central bin positions in the virtual array, the ticket images can be switched or otherwise reordered to place the images of the lesser-selling tickets to bin positions in the virtual array that generate more sales.

In a certain embodiment, the benefits and functionality of the electronic display may be desired without necessarily locating the display remote from the physical dispenser array. In this embodiment, the display may be removably attachable to a front face of the physical dispenser array by any suitable means, such as mechanical clips, hook/loop fasteners, and so forth.

It may be desired that the electronic display is further configured to visually highlight selected bin positions in the virtual dispenser array to drawn more attention to the selected bin positions. For example, in order to increase the sale of tickets corresponding to images in certain bin positions in the virtual array, such pin positions may be back-lit, framed with lights, or generally rendered more noticeable or visually appealing as compared to the other bin positions in the virtual array. For example, the corner bin positions in the virtual array may be highlighted in this regard if it is determined that such positions are weak selling bin positions. This feature may be used alone or in combination with changing image bin positions in the virtual array.

In one embodiment, the central lottery server is configured to change bin position assignments for the lottery ticket images in the virtual dispenser array according to a predetermined schedule. For example, bin position assignments may be changed on a daily schedule so that each image has time spent in each bin position. Over time, this feature may result in a more even sales distribution of the lottery tickets.

In on embodiment, the control system is a central system that is common to (and in communication with) all of the bins in the array for performing the functions discussed herein. In another embodiment, the control system may be an individual system configured with each bin. For example, each bin may include a control board with logic circuitry to control the dispense mechanism, scanner, and to perform the functions described herein.

The architecture of each bin can vary within the scope of the invention. For example, in one embodiment, each bin may include a bottom base portion that is configured for interconnecting the bins, wherein the first electronic display is mounted in the bottom base portion. With this configuration, the back side of the bin may include a pivotal door that opens to the internal space for loading of the stack of lottery tickets into the bin, wherein the pivotal door is mounted above the bottom base portion. The scanner, electronic drive mechanism, and control board may all be mounted on the pivotal door.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
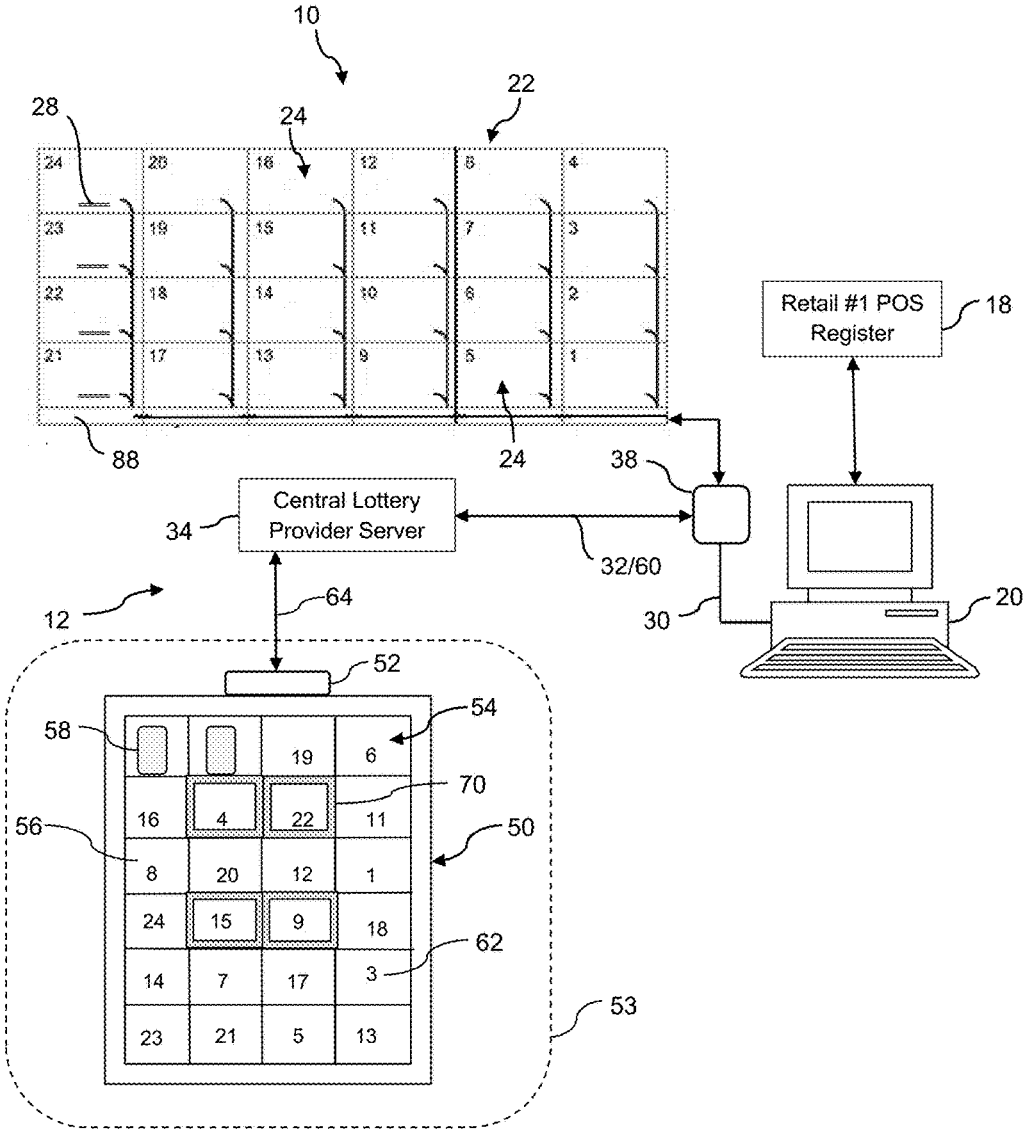
FIG. 1 is a block diagram of a lottery ticket dispenser array system in accordance with aspects of the present invention.
Figure 3:
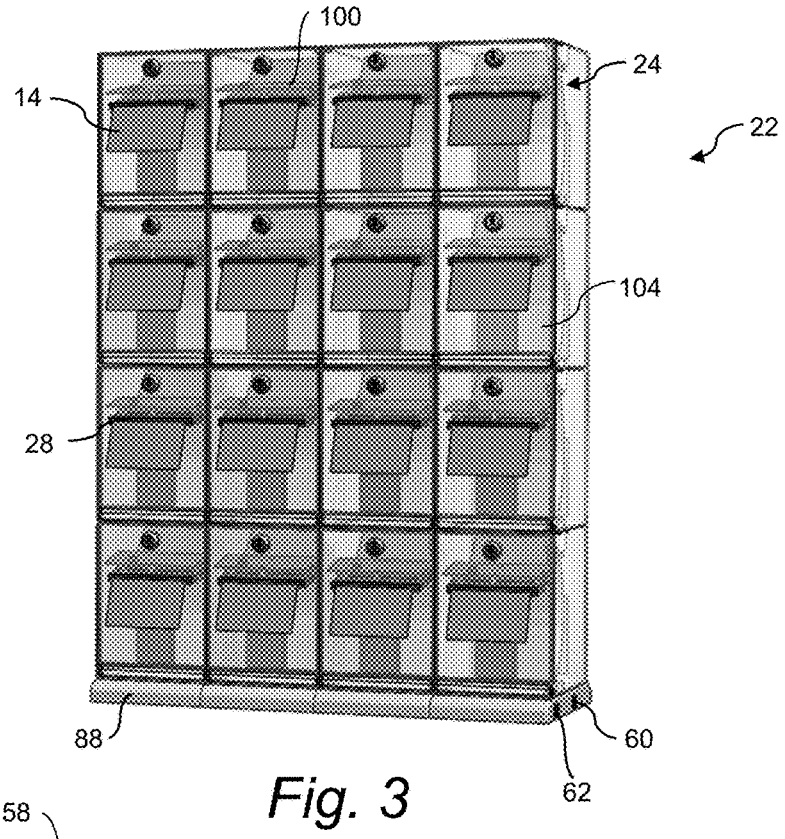
FIG. 3 is a back perspective view of an embodiment of a lottery ticket dispenser array.

FIG. 1 depicts an embodiment of a system 10 and related methodology for dispensing lottery tickets 14 (FIGS. 3 and 4) at a retail establishment 12. As mentioned above, the type of retail establishment 12 may vary widely within the scope and spirit of the invention. A retail establishment or location 12, such as a retail store, convenience store, pub, restaurant, or the like, is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment 12 or lottery jurisdiction entities are not limiting factors of the invention. Although not limited to such, the present system 10 has particular usefulness for larger retail establishments, such as "big-box" retail stores that are part of a national or other geographic chain.

The retail establishment 12 includes one or more retail point-of-sale (POS) registers 18 wherein patrons of the establishment 12 purchase goods. Typically, a scanner is associated with the POS register 18 to scan a UPC code on the products, with the UPC code linked to a purchase price and identification of the products, as is well-known in the art.

In the embodiment of FIG. 1, a lottery ticket terminal 20 is configured in wired or wireless communication with the retail POS register 18 to accept a request for purchase of a particular lottery ticket 14 (FIG. 3) selected from a plurality of different lottery tickets made available to patrons for purchase. This request may be input directly to the terminal 20 or come via the POS register 18. The lottery tickets 14 may be, for example, conventional instant scratch-off lottery tickets. Various types of lottery ticket terminals are known in the art and suitable for configuration with a system 10 in accordance with the invention. For example, Scientific Games Corporation having a principal place of business in Alpharetta, Ga., USA, offers Flair™ and Wave™ lottery ticket terminals that may be readily configured by those skilled in the art for a system as described herein.

A patron's request for a particular scratch-off lottery ticket may be input into the lottery ticket terminal 20 by a retail clerk or other employee of the retail establishment 12 by various means. For example, the terminal 20 may be configured with a scanner, wherein the clerk scans a "master" card having a code corresponding to the particular lottery ticket 14 requested by the patron. Thus, a master card or master code would be provided for each type of lottery ticket 14 offered by the establishment 12. In another embodiment, the terminal 20 may be configured with a touch-screen, keyboard, or other data input device, wherein the clerk enters or identifies the ticket 14 requested by the patron.

Still referring to the embodiment of FIG. 1, a "smart" lottery ticket dispenser array 22 is in wired or wireless communication with the terminal 20. This dispenser array includes one or a plurality of individual lottery ticket bins 24, with each bin 24 typically containing a different respective lottery ticket game. For example, one bin 24 may contain "Lucky 7" themed scratch-off lottery tickets 14, while an adjacent bin 24 may contain "Gold Rush" themed scratch-off lottery tickets 14, and so forth.

As described above, unlike conventional lottery ticket dispensers, the array 22 need not serve the function of advertising or otherwise informing patrons of the different lottery tickets available for purchase. Thus, it is not necessary to locate the array 22 at a location in the retail establishment that is visible to the patrons.

Figure 6:
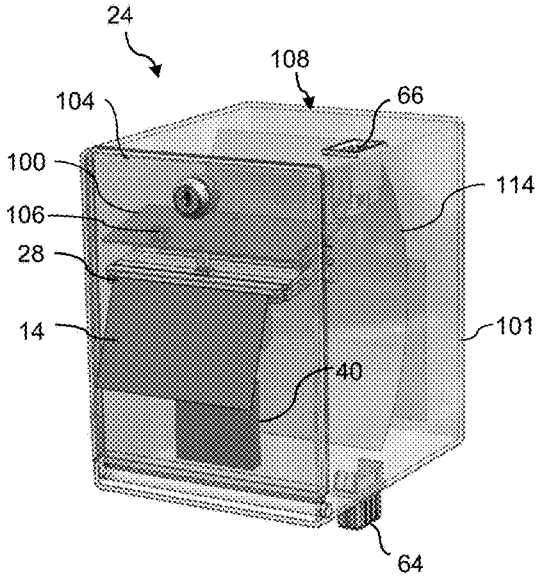
FIG. 6 is a front perspective view of a lottery ticket bin in accordance with the invention.

Each lottery ticket 14 in the different bins 24 includes a machine readable code 15 (FIG. 6) printed on a front or back side thereof, such as an alpha-numeric code, bar code, QR code, or the like. The type of code may vary depending on the desired information content of the code, space on the ticket 14, and so forth. The use of such codes on lottery tickets 14 for various functions related to inventory, identification, verification, and security are well-known. In accordance with aspects of the invention, the lottery tickets in each bin 24 are generally loaded as a fan-folded stack or roll of sequentially numbered tickets, wherein the machine readable code on each lottery ticket 14 contains this number (as well as any manner of additional ticket information), for example in the form of a serial number embedded in the code.

Referring to the figures in general, each bin 24 in the dispenser array 22 includes an electronic drive mechanism 26 that, when activated, dispenses one or more lottery tickets 14 from the bin 24 (depending on the number of tickets requested by the patron). This drive mechanism 26 may include a motor that drives a friction roller, wherein the tickets 14 are engaged between the friction roll and an idler roll such that driven rotation of the friction roll causes the tickets 14 to be advanced through a dispensing slot 28 in a wall of the individual bin 24. The drive mechanism 26 may also include a sensor 106 that detects a leading and/or trailing edge of adjacent tickets 14 so as to control the run time of the drive mechanism 26 to ensure that perforations between the tickets 14 are presented at a tear bar or other cutting mechanism adjacent to the dispensing slot. For example, the sensor 106 may be an optical sensor that detects the perforation line between adjacent tickets. Alternately, the friction or idler roll may include an electrical or mechanical encoder that indirectly measures the length of a ticket passing between the rolls as a function or rotations of the roller. In another embodiment, a timing circuit may control the dispense cycle as a function of run time of the motor. It should be appreciated that the drive mechanism 26 may be variously configured to perform the functions of dispensing the requisite number of tickets 14 from the individual respective bin 24 within the scope and spirit of the invention.

In the illustrated embodiments, each bin 24 also includes a scanner 40 disposed so as to read the code on the lottery tickets 14 as they are dispensed from the bin 24. The scanner 40 may be any conventional barcode reader, such as a point scanner, linear scanner, laser scanner, LED image scanner, and so forth. The tickets 14 are loaded into the bins 24 such that the code printed on each ticket passes within the detection field of the scanner 40. An integral (or separate) reader is configured with the scanner 40 to decode the scanner signal.

For each bin 24, a control system 38 is in communication with the scanner 40 and is specifically configured for receipt of the scan signal from the scanner 40. Referring to FIG. 1, the control system 38 may be a central system that is common to (and in communication with) all of the bins 24 in the array 22 for performing the functions discussed herein. This central control system 38 may be physically configured with the array 22 (e.g., within a base structure 88) or may be remote from the array 22.

Figure 2:
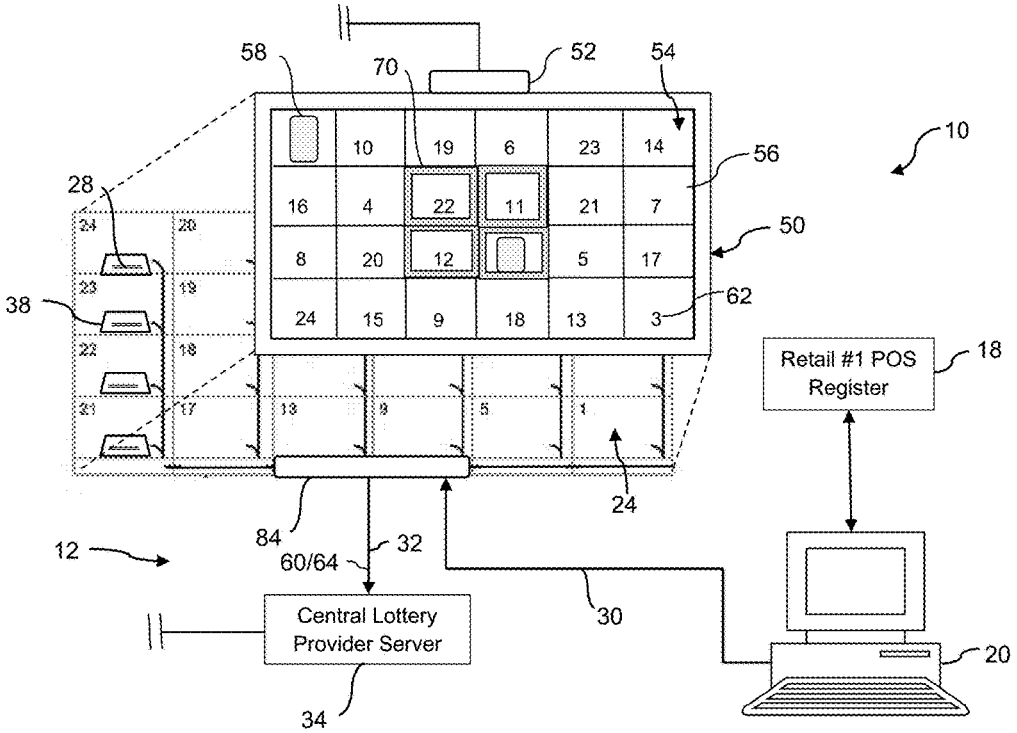
FIG. 2 is a block diagram of another embodiment of a lottery ticket dispenser array system in accordance with aspects of the present invention.

In another embodiment depicted for example in FIG. 2, the control system 38 may be an individual system configured with each bin 24. For example, referring to FIGS. 7 and 8, each bin 24 may include a control board 100 having logic circuitry to control the various components within the bin 24, such as the leading edge sensor 106, drive motor timing circuit, electronic displays 107, 109, and so forth. Any manner of control or power components can be mounted on the board 100 for operation of the individual bins 24 as described herein. FIG. 2 depicts individual control systems 38 for each bin 24 in direct communication with the terminal 20 via a signal router 84 integrated with the dispenser array 22. This router 84 routes the purchase signal 30 from the lottery ticket terminal 20 to the correct bin 24. The control system 38 performs additional functions, as described below.

The system 10 includes a central lottery server 34 that may be common to a number of different retail establishments 12. As described above, as the tickets 14 are dispensed from the bin 24, the scanner 40 reads the code printed on each ticket. A signal 32 corresponding to the scanned code may be routed to the central lottery server 34 for each lottery ticket dispensed from the dispenser array 22 to enable certain actions relevant to the sale/dispensing/accountability of the individual tickets 14. For example, the central lottery server 34 may include a database of all tickets delivered to the respective retail establishments 12, and the near instantaneous identification of dispensed/sold lottery tickets 14 to the server 34 enables various desired functionalities. For example, the individual lottery tickets 14 may remain "inactive" in the lottery provider's system (and thus unable to be redeemed) until individually activated by the central lottery server 34 as they are dispensed and sold. Thus, fraudulently obtained tickets (e.g., stolen or otherwise illegally obtained) cannot be redeemed. This is contrary to a conventional practice of activating entire books ("packs") of tickets upon delivery to a retail establishment 12.

Referring to the figures in general, an electronic display device 50 is in communication with the central lottery server 34. This display device 50 may be, for example, a video monitor or screen (e.g., an LCD screen). The electronic display device 50 is configured to present a virtual dispenser array 54 with virtual bin positions 56. The virtual array 54 mimics a physical dispenser array in that it is an electronic image representation of a physical array. The virtual image 54 need not be identical to the physical array 22, but generally depicts a dispenser array in grid-type configuration that customers are familiar with.

The physical dispenser array 22 may be located below the counter at the retail check-out register, but still accessible to the store clerk for retrieving the tickets 14 dispensed automatically therefrom. The electronic display device 50, on the other hand, may be mounted on a wall or other support surface 53 near the register 18 or lottery terminal 20 so as to be readily seen by customers without occupying valuable space on or near the retail counter.

In a certain embodiment, the virtual array 54 will include the same number of bin positions 56 as the physical array 22, and may display the bin positions 56 is the same pattern as the physical array 22, as depicted in the embodiment of FIG. 2. In another embodiment as depicted in FIG. 1, the virtual array 54 displays the bin positions 56 in a different grid pattern as compared to the physical array 22.

The central lottery server 34 is configured to transmit lottery ticket images 58 to the electronic display device 54, wherein the images 58 correspond to the actual lottery tickets 14 in the physical dispenser array. Each image 56 is displayed in a respective virtual bin 56 in the virtual array 54. These images 58 may be generated and stored in a library that is accessed by the central lottery server 34.

The central lottery server 34 is also configured to transmit bin position assignments (depicted by the numbers 62 in the bin positions 56) to the electronic display device 50. These bin position assignments 62 dictate the bin positions 56 in the virtual array 54 for the respective lottery ticket images 58.

For illustrative purposes, in FIGS. 1 and 2, the physical bins 24 are sequentially numbered and ordered (e.g., from "1" through "24"), with each bin 24 containing a different lottery ticket 14. However, bin positions 56 in the associated virtual array 54 that depict ticket images 58 corresponding to the tickets in the physical bins are not in the same sequential order, but are variously located in the virtual array 54. For example, bin "1" in the physical array 22 is in the bottom right-hand corner, but the bin position 56 having the ticket image 58 corresponding to the tickets in the physical bin 24 (bin "1") is in a completely different position in a different grid configuration of the virtual array 54 (FIG. 1). Thus, the grid configuration of ticket images 58 in the virtual array 54 need not correspond to the physical array 22.

The control system 38 associated with the physical array 22 is configured to generate a bin ID and a lottery ticket ID signals 60 upon the supply of lottery tickets 14 being loaded into each bin 24 of the physical array 22, and to transmit these signals 60 to the central lottery server 34. The ticket ID signal can be generated from information contained in the ticket codes 15 printed on the lottery tickets 14 and scanned by the bin scanner 40 upon loading the tickets 14 into a respective bin 24. The bin ID signal may be a hard-wired signal associated with each bin based on its position in the array 22. With this information, the central lottery server 34 is able to determine precisely which type of game ticket 14 is in each physical bin 24 and track the number of actual lottery tickets 14 dispensed (e.g., sold) from each of the different bins 24 in the physical dispenser array 22. Thus, the central lottery server 34 is able to determine ticket inventory in the respective bins 24 at any given time, and which tickets are not selling as quickly as others.

Based on this information, the central lottery server 34 is configured to generate new bin position assignments 62 for the lottery ticket images 58 in the virtual dispenser array 54. These new bin positions may be based on any combination of factors (e.g., number of tickets remaining in any given game, age of the game, etc.), but generally will be for the purpose of increasing or decreasing sales of certain lottery tickets as a function of position of the virtual bin 56 in the virtual dispenser array 54. For example, if tickets 14 corresponding to images 58 located in the corner bin positions 56 of the virtual array are not selling as well as tickets corresponding to more central bin positions 56 in the virtual array 54, the ticket images 56 can be switched or otherwise reordered to place the images 56 of the lesser-selling tickets 14 in bin positions 56 in the virtual array 54 that generate more sales.

The virtual bins 56 that generate more or less sales can be determined based on past sales, or by any other analysis method.

Figure 4:
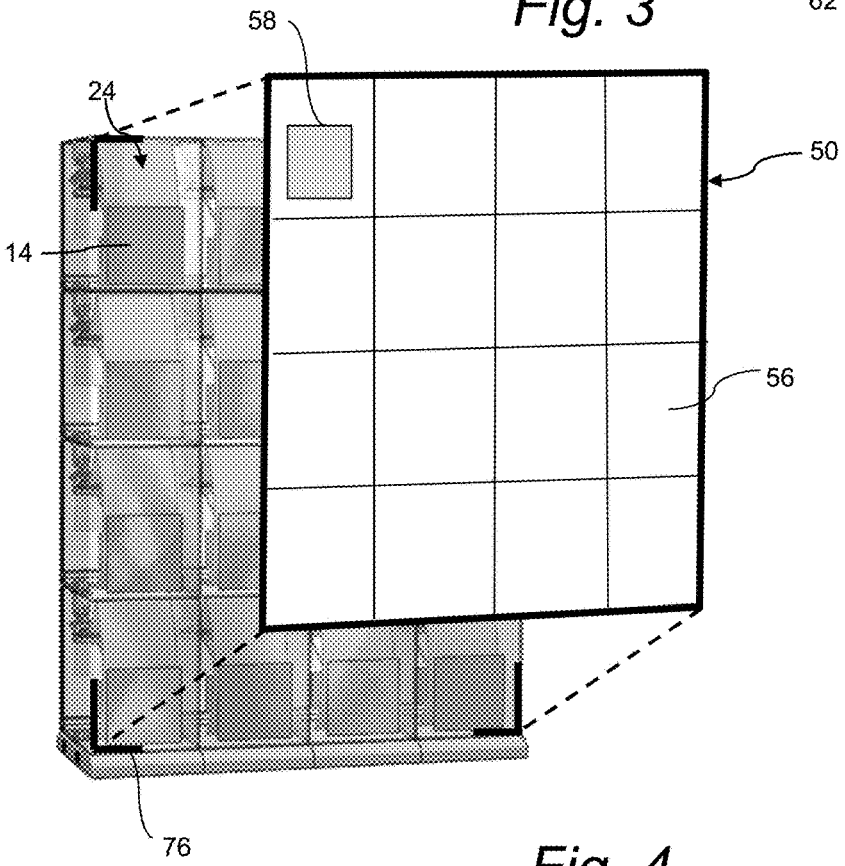
FIG. 4 is a front perspective view of the lottery ticket dispenser array of FIG. 3 with an associated electronic display device.
Figure 5:
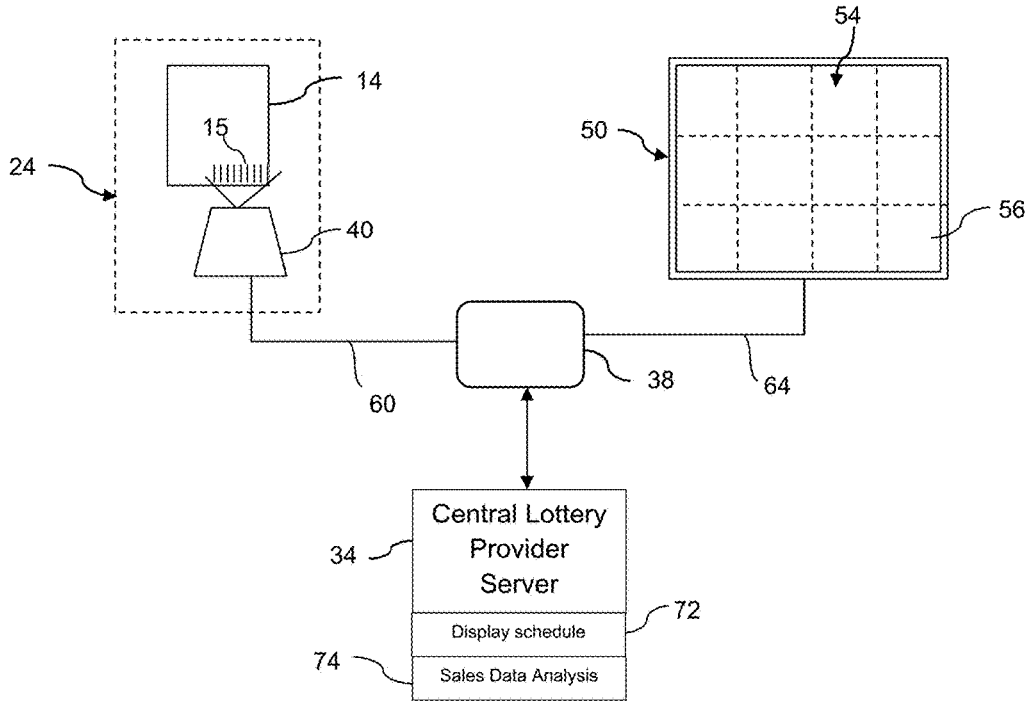
FIG. 5 is a diagram view of certain control aspects of the lottery ticket dispenser.

In a certain embodiment, the benefits and functionality of the electronic display device 50 may be desired without necessarily locating the display 50 remote from the physical dispenser array. Referring to FIG. 4, the display 50 may be removably attachable to a front face of the physical dispenser array 22 by any suitable means 76, such as mechanical clips, hook/loop fasteners, and so forth.

It may be desired that the electronic display device 50 is further configured to visually highlight selected bin positions 56 in the virtual dispenser array 54 to drawn more attention to the selected bin positions 56, as depicted in FIGS. 1 and 2. For example, in order to increase the sale of tickets 14 corresponding to images 58 in certain bin positions 56 in the virtual array 54, such pin positions may be back-lit, framed with lighting, or generally rendered more noticeable or visually appealing as compared to the other bin positions 56 in the virtual array 54 with any manner of visual highlighting means 70. For example, the corner bin positions 56 in the virtual array 54 may be highlighted if it is determined that such positions 56 are weak selling bin positions. This feature may be used alone or in combination with changing image bin positions in the virtual array 54.

In one embodiment, the central lottery server 34 is configured to change bin position assignments 62 for the lottery ticket images 58 in the virtual dispenser array 54 according to a predetermined schedule. For example, bin position assignments 62 may be changed on a daily schedule so that each image 58 has time spent in each bin position 56. Over time, this feature may result in a more even sales distribution of the lottery tickets 14.

Referring to FIGS. 1 and 2, the lottery ticket terminal 20 transmits a purchase signal 30 for dispensing a particular lottery ticket 14 that is routed to the respective bin 24 within the dispenser array 22 containing the requested lottery ticket. This purchase signal 30 may be sent to an individual control system 38 associated with the bin 24 (FIG. 2), or to a common control system 38 associated with all of the bins 24 (FIG. 1), to activate the drive mechanism 26 and dispense the requisite number of lottery tickets 14 from the bin 24.

In an alternate embodiment, the purchase signal 30 is generated by the POS register 18 and transmitted to the control system 38 after the POS register 18 receives a purchase code from the lottery ticket terminal 20 corresponding to the particular ticket requested by the patron.

In addition to the functionality of the virtual dispenser array 54, the present system 10 allows for enhanced accountability of lottery tickets 14 sold at a particular retail establishment 12 by logging each ticket as it is sold and dispensed. The number of tickets 14 sold during a work shift (or other time period) is easily determined by generating a report by the central server 34 of the tickets sold at any of the retail establishments during any defined time period. The number of tickets 14 sold at any of the retail establishments 12 can be readily reconciled with tickets delivered to the establishment. Likewise, the number of tickets 14 dispensed during a defined time can be readily and electronically reconciled with reported purchase transactions from the respective establishment 12, with discrepancies being immediately identified for further investigation.

Another particular advantage of the system 10 and associated method is that billing practices between the retail establishments 12 and lottery authority, the lottery service provider, or ticket manufacturer can be based on real-time sales of the lottery tickets 14. For example, the retail establishments 12 can be invoiced on a periodic basis (e.g., daily or weekly) for the actual number of tickets sold (dispensed) at each respective establishment based on the signals 32 routed to the central lottery server 34 instead of upon delivery, or other payment methodology typically in use today. These include but are not limited to consignment for a predetermined time period, or estimate of sales based on the number of winning tickets cashed from a pack of tickets being sold.

It should be appreciated that the terms "server" is used herein to encompass any configuration of computer hardware and software that is maintained by a lottery authority or game provider to carry out the functionalities of the present system 10 and associated method, as well as any manner of additional lottery functions known to those skilled in the art. It should be readily appreciated that the server 34 may include an integrated server, or any manner of periphery server or other hardware structure. The central lottery server 34 is typically remote from the retail establishments 12, and is in communication with the establishments 12 via a suitable secure communication network, which may include any manner of wide area network, wireless internet, or cloud computing. The server 34 may be a single networked computer, or a series of interconnected computers having access to the communications network via a gateway or other known networking system. Generally, the server 34 is configured to communicate with, manage, execute and control individual lottery terminal units 20 within the lottery jurisdiction. The server 34 may be a "front end" server provided by the lottery game provider that is interfaced with the existing draw/instant game system infrastructure one or more separate lottery authorities. The server 34 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 10.

The server 34 may be directly or indirectly connected through an I/O bus to any manner of peripheral devices such as storage devices, wireless adaptors, printers, and the like. In addition, a database (DB) may be communicatively connected to the server 34 and provide a data repository for the storage and correlation of information gathered from the individual dispenser arrays 22, such as the identity of each lottery ticket 14 dispensed from the array, the time of the dispense sequence, confirmation of ticket activation, and so forth.

It should be appreciated that embodiments of the methods and systems 10 disclosed herein may be executed by one or more suitable networked lottery gaming components and establishment components (e.g., POS register 18, back office server, and so forth) within a plurality of the establishments 12, as well as the remote central server 34. Such gaming systems and computing devices may access one or more computer-readable media that embody computer-readable instructions which, when executed by at least one computer, cause the computer(s) to implement one or more embodiments of the methods of the present subject matter. Additionally or alternatively, the computing device(s) may comprise circuitry that renders the device(s) operative to implement one or more of the methods of the present subject matter. Furthermore, components of the presently-disclosed technology may be implemented using one or more computer-readable media.

As mentioned above, aspects of the present system 10 and methods rely on the transmission of data over one or more communications networks. It should be appreciated that network communications can comprise sending and/or receiving information over one or more networks of various forms. For example, a network can comprise a dial-in, public switched telephone network (PSTN), a local area network (LAN), wide area network (WAN), the Internet, an intranet or other type of network. A network may comprise any number and/or combination of hard-wired, wireless, or other communication links.

The architecture of each bin 24 and the array 22 can vary within the scope of the invention. Referring to FIGS. 1 through 4, the dispenser array 22 includes a bottom row of bins 24 having interconnected base structures 88. For example, each base structure 88 may include a male power plug and male data plug along one side, and a female power port 60 and female data port 62 along the opposite side. The plugs and ports of adjacent base structures 88 interconnect to essentially define a data bus running the length of the base structures 88. An exposed power port 60 and data port 62 at one of the ends of the interconnected base structures is available for connection with a power cord and a data cord from the system control system 38 or lottery terminal 20.

Figure 7:
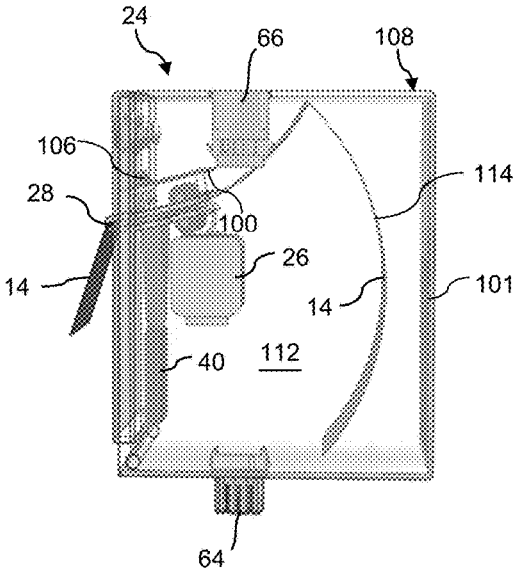
FIG. 7 is a side view of the bin embodiment of FIG. 6.

Referring to certain embodiments depicted in FIGS. 7 and 8 in particular, each of the individual bins 24 includes a multi-sided housing 108 defining an internal space 112 in which the stack or roll of lottery tickets 14 is stored. In the depicted embodiments, the housing 108 is a box-like member having top and bottom walls, side walls, a front wall 101, and a pivotal back wall or panel 104. The back panel 104 swings open to provide access into the housing 108 for loading the ticket stack. As shown in FIG. 4, each bin 24 may include a sample ticket 14 or other identifying insert attached to a front face of the bin 24. Each bin 24 includes a male power/data connector 64 on the top or bottom surface, and a corresponding female power/data connector 66 on the opposite surface, as seen in FIGS. 7 and 8. With this configuration, a plurality of the bins 24 can be vertically stacked and interconnected, as depicted in the various figures.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser system, comprising:

a physical dispenser array, the dispenser array comprising a plurality of separate bins, each bin defining an internal space for receipt of a supply of interconnected lottery tickets;

each bin having an electronic drive mechanism that dispenses the lottery tickets therefrom;

a control system in communication with the drive mechanism to initiate a dispense sequence upon receipt of a ticket dispense command;

a central lottery server, the control system in communication with the central lottery server;

an electronic display device in communication with the central lottery server, the electronic display device presenting a virtual dispenser array with bin positions that mimics the physical dispenser array;

the central lottery server transmitting lottery ticket images to the electronic display device that correspond to the lottery tickets in the physical dispenser array and bin position assignments for the lottery ticket images in the virtual dispenser array; and wherein the electronic display device is positionable remotely from the actual dispenser array in a retail establishment and presents the virtual dispenser array to potential customers.

2. The lottery ticket dispenser system as in claim 1, wherein the control system is configured to generate a bin ID signal and a lottery ticket ID signal upon the supply of lottery tickets being loaded into each bin and to transmit the bin ID signal and ticket ID signal to the central lottery server, wherein the central lottery server tracks the lottery tickets dispensed from the bins in the physical dispenser array.

3. The lottery ticket dispenser system as in claim 2, wherein the central lottery server generates new bin position assignments for the lottery ticket images in the virtual dispenser based on the tracked lottery tickets dispensed from the physical dispenser array, the new bin positions determined so as to increase or decrease sale of the lottery tickets as a function of bin position in the virtual dispenser array.

4. The lottery ticket dispenser system as in claim 2, wherein the lottery tickets include a code printed thereon that uniquely identifies the lottery ticket, each bin further comprising a scanner in communication with the control system and disposed to read the code once the lottery tickets are loaded into the bin, the control system generating the lottery ticket ID signal from the ticket codes.

5. The lottery ticket dispenser system as in claim 1, wherein the electronic display is removably attachable to a front face of the physical dispenser array.

6. The lottery ticket dispenser system as in claim 1, wherein the electronic display is further configured to visually highlight selected bin positions in the virtual dispenser array.

7. The lottery ticket dispenser system as in claim 1, wherein the central lottery server is configured to change bin position assignments for the lottery ticket images in the virtual dispenser array according to a predetermined schedule.

8. The lottery ticket dispenser system as in claim 1, wherein the virtual array displays a same number of bin positions as are in the physical array.

9. The lottery ticket dispenser system as in claim 8, wherein the virtual array displays the bin positions in a same pattern as the physical array.

10. The lottery ticket dispenser system as in claim 8, wherein the virtual array displays the bin positions in a different pattern as compared to the physical array.

* * * * *